United States Patent [19]

Geiser, Jr.

[11] Patent Number: 4,651,455

[45] Date of Patent: Mar. 24, 1987

[54] BOLT ACTION RIFLE

[76] Inventor: John D. Geiser, Jr., P.O. Box 653, Blue Ridge Summit, Pa. 17214

[21] Appl. No.: 747,245

[22] Filed: Jun. 21, 1985

[51] Int. Cl.[4] ..... F41C 11/00; F41C 17/00; F41C 19/00; F41C 25/02

[52] U.S. Cl. ..... 42/18; 42/16; 42/22; 42/69.03; 42/70.01; 42/70.08; 42/75.01; 42/75.03

[58] Field of Search ..... 42/16, 70.01, 75.03, 42/18, 22, 69.03, 70.08, 75.01, 75.03

[56] References Cited

U.S. PATENT DOCUMENTS

| | | | |
|---|---|---|---|
| 639,421 | 12/1899 | Mauser | 42/70.01 X |
| 1,291,689 | 1/1919 | Sheppard | 42/16 X |
| 2,030,149 | 2/1936 | Mossberg | 42/16 |
| 2,824,402 | 2/1958 | Fischer | 42/70.01 |
| 2,869,269 | 1/1959 | Couture | 42/70.01 X |
| 3,380,182 | 4/1968 | Browning | 42/75.03 |
| 3,636,648 | 1/1972 | Spencer | 42/16 |
| 3,742,638 | 7/1973 | Archer | 42/16 X |
| 3,939,589 | 2/1976 | Tellie | 42/75.03 X |
| 4,471,551 | 9/1984 | Mattarelli | 42/70.01 |

*Primary Examiner*—Deborah L. Kyle
*Assistant Examiner*—Ted L. Parr
*Attorney, Agent, or Firm*—Brady, O'Boyle & Gates

[57] ABSTRACT

A bolt action rifle of simplified, economical and durable construction resembling an assault rifle is disclosed. An elongated action tube connected between a barrel and stock houses and guides the bolt in all positions of the latter. A unified housing member attached to the action tube defines a magazine having communication with the interior of the action tube and a mounting for a simplified firing and safety mechanism involving a minimum number of parts.

17 Claims, 11 Drawing Figures

BOLT ACTION RIFLE

BACKGROUND OF THE INVENTION

The objective of the present invention is to provide a knockabout all-weather bolt action rifle of great simplicity and ruggedness of construction, and low manufacturing cost compared to conventional bolt action rifles. A further object of the invention is to provide a rifle having the appearance of a modern assault rifle and which requires only the minimum care and maintenance normally given to an assault rifle in the field.

An important feature of the invention resides in the provision of an elongated action tube connected between the rifle barrel and stock, and serving to entirely enclose and guide the bolt during its forward and rearward travel, whereby the bolt is precisely controlled at all times, in contrast to conventional bolt action rifles where the bolt is not fully supported during the full extent of its rearward travel. The arrangement greatly increases the smoothness and precision of bolt operation, and eliminates any tendency for the bolt to bind as sometimes occurs with conventional bolt actions.

A further important object of the invention is to provide a bolt action rifle which requires only simple and comparatively inexpensive machining operations by means of conventional, readily available tools, in contrast to the special and expensive tooling generally required for the manufacturing of conventional bolt action rifles.

Another object and feature of the present invention is to eliminate the costly internal bolt guide rails of conventional bolt action rifles and to employ a simple milled guide slot in the action tube to guide the bolt in its longitudinal and circumferential movements. The bolt itself is simply a solid steel cylinder requiring only external machining operations, except for a longitudinal passage for the firing pin which is formed by a drill bit. The bolt in the conventional bolt action rifle generally requires intricate internal and external machining.

A further feature and advantage of the present invention over the prior art resides in the provision of a simplified and reliable integrated firing and safety mechanism which involves fewer parts and less manufacturing cost than the comparable mechanisms of conventional firearms of the general type involved in the present invention.

Still another object of the invention is to provide a common unitary body serving as a magazine for the rifle and a mount for the firing mechanism and safety, said body being attached directly to the action tube.

Other features and advantages of the invention will become apparent to those skilled in the art during the course of the following description.

DETAILED DESCRIPTION

Figure 1:
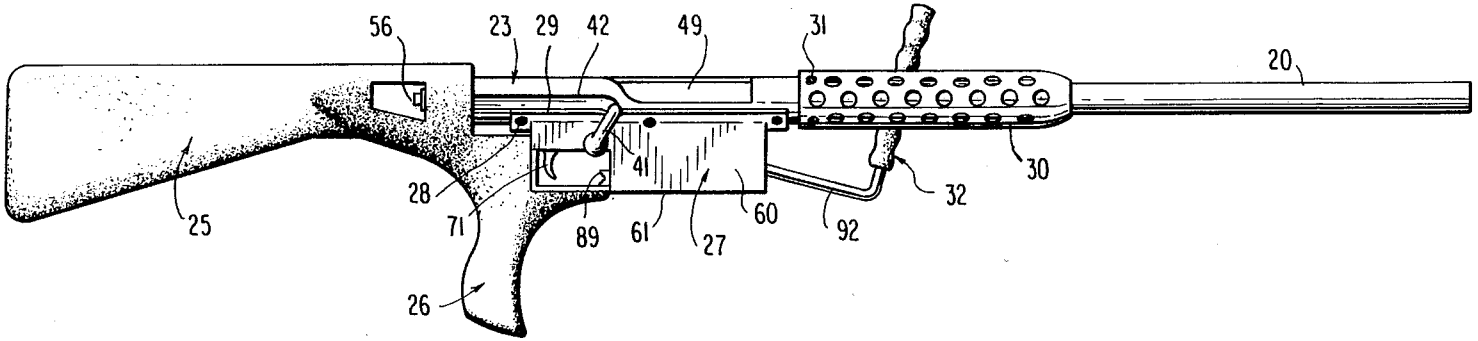
FIG. 1 is a side elevation of a bolt action rifle according to the present invention.
Figure 2:
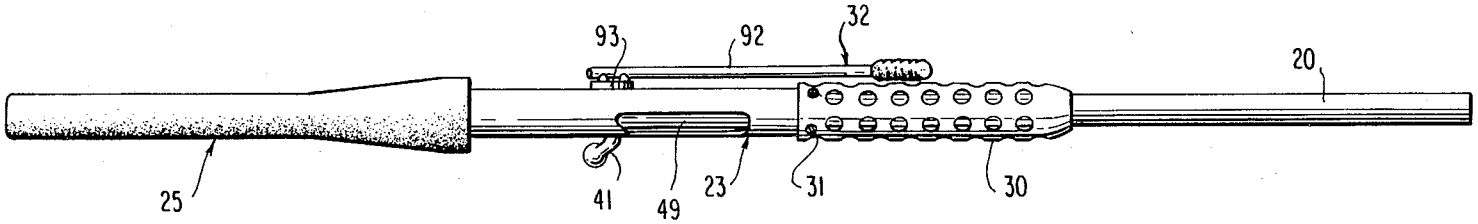
FIG. 2 is a plan view of the rifle.
Figure 4:
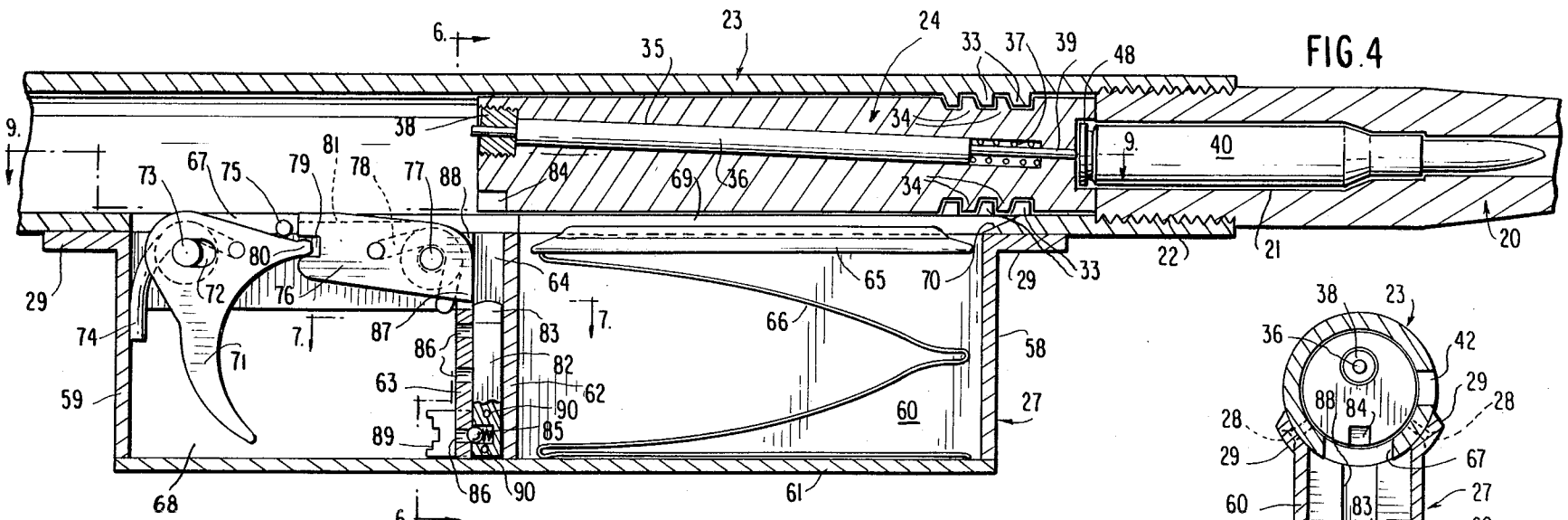
FIG. 4 is an enlarged fragmentary central vertical section taken through the action tube, bolt and the magazine and firing mechanism body.
Figure 6:
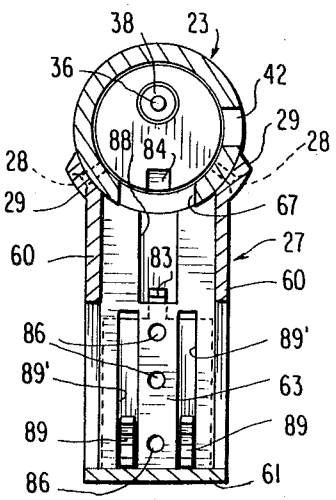
FIG. 6 is a vertical section taken on line 6—6 of FIG. 4.
Figure 7:
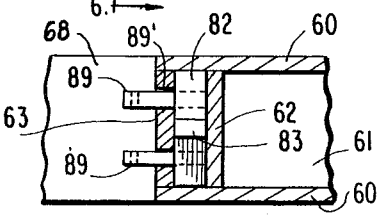
FIG. 7 is a fragmentary horizontal section taken on line 7—7 of FIG. 4.

Referring to the drawings in detail wherein like numerals designate like parts, a simplified bolt action rifle according to the invention comprises a barrel 20 having a cartridge chamber 21 at its rear end, FIG. 4, and being threadedly engaged by screw threads 22 with the forward end of an elongated action tube 23 containing a bolt 24. At its rear end, the action tube 23 is securely connected by means to be described to a preferably plastics material stock 25 having a hand grip portion 26. A unitary body or housing 27 defining a cartridge magazine and a firing mechanism and safety mount is attached directly to the lower side of the action tube 23 by screws 28 received through arcuate flanges 29, FIG. 6, on the opposite sides of the body 27 at its top. A ventilated metal hand grip 30, FIGS. 1 and 2, surrounds the rear end portion of the barrel 20 and is attached by screws 31 to the action tube 23.

The rifle is equipped with an easily adjustable carrying handle 32 whose construction and operation will be described hereinafter.

The above are the main components of a bolt action rifle whose appearance is preferably the appearance of a modern assault rifle, as previously stated. Two major areas of uniqueness in the rifle forming the subject matter of the invention will now be described in detail. One of these areas involves the action tube 23 which contains the bolt 24, and the other area involves the common unitary magazine, firing mechanism and safety mechanism body or housing 27 attached to the bottom of the action tube 23.

Near and somewhat rearwardly of its screw-threaded forward end, the action tube 23 is provided with a plurality of internal circumferentially spaced bolt locking lugs 33, preferably at least six in number. These locking lugs are produced by longitudinal milling of internal buttress screw threads. The lugs 33 interact with external locking lugs 34 machined on the bolt 24.

The bolt 24 is drilled longitudinally on a shallow angle to its axis to form a firing pin bore 35, FIG. 4, receiving therein a firing pin 36 and a spring 37 biasing the firing pin rearwardly against a threaded firing pin retainer plug 38 threadedly engaged in the rear end of the bolt 24. The rear end of the firing pin 36 is eccentrically located relative to the central axis of the bolt, while its forward reduced pin extension 39 is centrally disposed in coaxial alignment with the percussion cap of a cartridge 40 occupying the chamber of the barrel. FIG. 4 shows the bolt 24 in its fully closed and locked position.

The bolt 24 is equipped at its rear end with a handle 41 which operates in a longitudinal bolt guide slot 42 formed in the action tube 23, the slot 42 extending through the rear end of the action tube. At its forward end, the guide slot 42 has a short lateral bolt locking extension 43 which receives the root of the handle 41 to securely lock the bolt 24 in the forward closed position. The circumferential location of the guide slot 42 is finely coordinated with the location of the bolt locking lugs 33 and 34.

At its forward end, on one side thereof, the bolt 24 carries a cartridge extractor 44 attached to the bolt by a pivot pin 45 held within an opening in the bolt. A biasing spring 46 acting on the extractor 44 rearwardly of its pivot axis urges a hooked forward terminal 47 of the extractor 44 into engagement with the rim 48 of each cartridge 40 in the chamber 21 when the bolt is closed, as shown in FIG. 4. When the bolt is retracted by use of its handle 41, the extractor 44 will pull the empty cartridge case from the chamber 21 and move it rearwardly in the action tube 23 until the shell is adjacent to a loading and ejection port 49 formed through the top and one side of the action tube 23.

A shell ejector bar 50 fixed inside of the action tube 23 near the rear end of the loading and ejection port 49 passes through a longitudinal groove 51 formed in the exterior surface of the bolt 24 as the bolt is turned on its axis and moves rearwardly by the handle 41. When the rear end of the empty cartridge case strikes the fixed ejector bar 50 during retraction of the bolt, the case will be ejected through the port 49 of the action tube. The ejector bar 50 will strike the rear of the empty cartridge case near its bottom causing the case to tilt upwardly for proper ejection.

Figure 3:
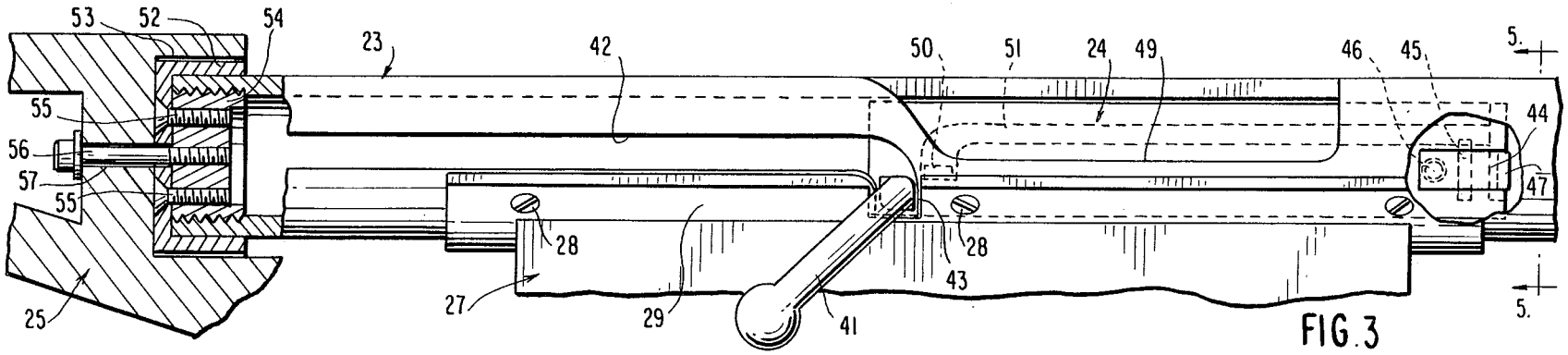
FIG. 3 is an enlarged fragmentary side elevation of the rifle, partly in section, showing the action tube and associated elements.

The rear end of the action tube 23 is secured to the stock 25 through an end cap 52, FIG. 3, received in a recess 53 of the stock. A threaded plug 54 in the rear end of action tube 23 is secured to the end cap 52 by screws 55. A bolt 56 is threadedly engaged centrally in the plug 54 and extends through an opening 57 in the stock for completing the attachment of the action tube 23 to the stock. The rear end of the action tube is thus fully supported on the stock and firmly attached thereto. The action tube is stabilized relative to the stock in all directions. The connection between the action tube and stock also compensates for the loss of metal in the action tube 23 caused by formation of the slot 42.

The unitized body or housing 27 includes forward and rear end walls 58 and 59, parallel side walls 60, a bottom wall 61 and a pair of spaced parallel internal partition walls 62 and 63 defining between themselves a safety bar guide passage 64.

Figure 11:
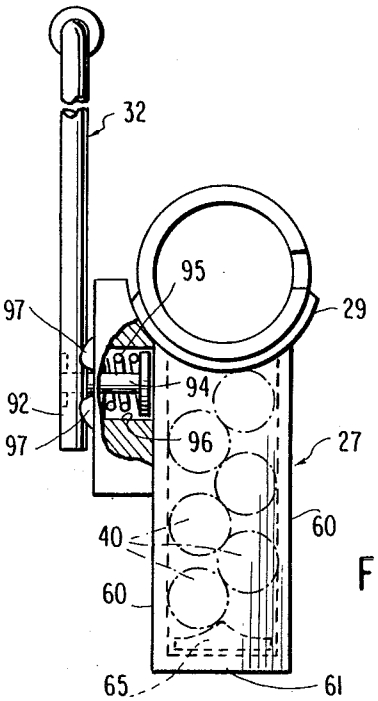
FIG. 11 is an end elevation of the elements shown in FIG. 10, partly in section.

A magazine chamber is defined in the body 27 between the partition walls 62 and forward end wall 58, and this chamber receives a cartridge follower 65 and cartridge follower spring 66. FIG. 11 of the drawings depicts the staggered arrangement of cartridges 40 in the magazine chamber above the cartridge follower 65.

Figure 9:
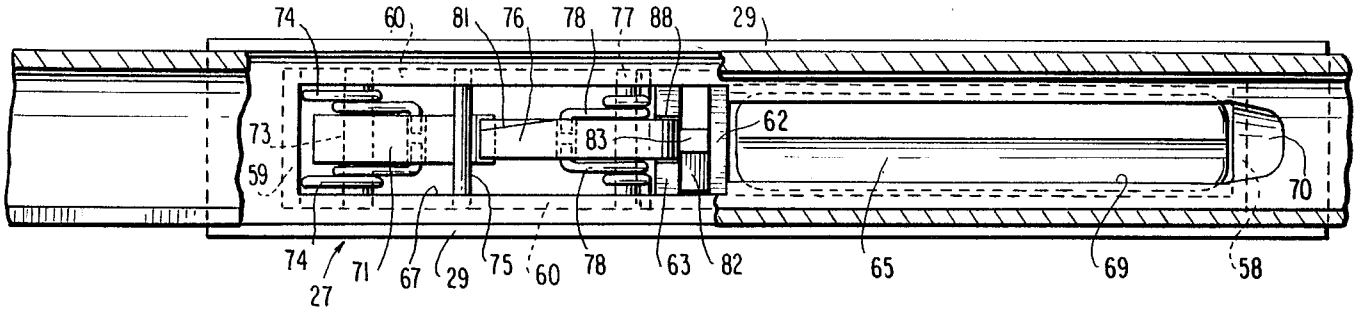
FIG. 9 is a horizontal section taken substantially on line 9—9 of FIG. 4.
Figure 8:
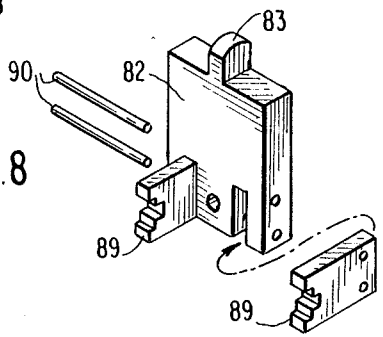
FIG. 8 is a partly exploded perspective view of a safety bar and operating buttons.

A cut-out or slot 67 is formed through the bottom of the action tube 23 above a rear chamber 68 of the unified body 27 for the firing mechanism of the rifle. The cut-out or slot 67 continues forwardly over the magazine chamber of the body 27 but is of somewhat reduced width in this region as shown at 69 in FIG. 9 to prevent the upward escape of the cartridge follower 65.

When the bolt 24 is retracted to the rear of the magazine chamber, the upward movement of the follower 65 under influence of the spring 66 will boost each cartridge 40 in succession through the slot 69 and into the interior of the action tube 23. The return of the bolt forwardly to the closed position shown in FIG. 4 will force the cartridge 40 into the chamber 21 ready for firing. A ramp surface 70, machined in the action tube 23 at the forward end of the slot 69 above the magazine, serves to guide the tapered projectile tip of each cartridge smoothly toward the chamber 21.

The firing mechanism of the rifle shown particularly in FIG. 4 is very simplified and comprises few parts which operate in a reliable manner. A trigger/sear 71 has an elongated opening 72 formed therethrough receiving a trigger/sear shaft 73 which is supported on the side walls 60 of the body 27. The trigger/sear 71 is biased counterclockwise in a non-firing direction on the shaft 73 by a torsion spring 74. A trigger/sear stop pin 75 also supported on the side walls 60 of the body 27 limits movement of the trigger/sear under influence of the spring 74.

A hammer 76 is mounted rotatably on a hammer shaft 77 forwardly of and parallel to the shaft 73. The hammer 76 is biased to the firing position by a torsion spring 78. The hammer has a notch 79 in its swinging end adapted to receive a tip 80 of the trigger/sear 71 which holds the hammer in the cocked position shown in FIG. 4. The hammer 76 is cocked by retraction of the bolt 24 in the action tube 23. It may be noted that the bolt 24 is fully enclosed and precision-guided in the bore of the action tube in all of its positions including closed and locked and fully opened.

When the hammer 76 is released for firing by pulling the trigger/sear 71, the existence of the elongated opening 72 reduces the extent of trigger movement necessary to release the hammer. This is true because tip 80 holding the hammer will move rearwardly as well as downwardly when leaving the notch 79. The released hammer 76 will then swing upwardly and strike the rear of firing pin 36 in the action tube 23.

As a measure to prevent possible damage to the rear of the firing pin 36, an angled cut 81 is made on the top rear face of the hammer. Normally, the hammer is cocked after the bolt is retracted for even a short distance. However, if one should close the action on an empty chamber and pull the trigger, the hammer then rests against the end of the firing pin. Then, if the bolt is opened only slightly, the hammer will slip off of the firing pin and will be resting at the side of the firing pin. This is true because rotation of the bolt to unlock it will cause the rear eccentric end of the firing pin 36 to travel toward one side of the hammer. Now, if an attempt is made to close the bolt tightly, the firing pin will jam against the side of the hammer as the firing pin moves toward the centered position shown in FIG. 4. This will result in probable damage to the firing pin. Therefore, the angled cut 81 is provided to allow the hammer to ride easily up onto the rear end of the firing pin.

An extremely simplified and reliable safety mechanism is provided. This mechanism comprises a safety bar 82 disposed movably in the guide passage 64 between partition walls 62 and 63. At its top, the safety bar 82 has a reduced width bolt locking extension 83 which is received in a locking cavity 84 formed in the rear end of the bolt on its lower side when the bolt is in the closed and locked position, FIG. 4. The safety bar 82 is equipped near its lower end with a spring-urged ball detent 85 engageable selectively in three safety bar positioning apertures 86 of the partition wall 63. When the ball detent 85 is engaged in the lower positioning aperture 86, FIG. 4, the safety is "off" and the hammer 76 is not restrained by the safety bar 82 and the mechanism is ready for firing. When the ball detent 85 is in the intermediate aperture 86, the safety bar 82 is positioned to lock the hammer 76 so that it cannot be released in the firing position by pulling the trigger. The lower corner 87 of the hammer will engage the safety bar 82 when the trigger is pulled and thus will be locked. There is an almost zero clearance between the lower corner 87 of the hammer and the safety bar 82 to assure proper operation of the mechanism. The corner 87 of the hammer can project through an opening 88, FIG. 6, formed in the partition wall 63 above the apertures 86. When the ball detent 85 is in the topmost aperture 86, the extension 83 is in the locking cavity 84 of the bolt and therefore the bolt and the hammer 76 are securely locked by the safety bar 82 and the rifle cannot be fired.

Another safety feature is provided by the eccentric location of the rear end of the firing pin 36. Even with the safety bar 82 in the lowermost position shown in FIG. 4, the rifle cannot be fired unless the bolt is closed to the position of FIG. 4 so that the rear of the firing pin 36 is in the path of movement of the hammer. Should the bolt 24 be rotated by the handle 41 or partly opened, the rear end of the firing pin will travel to one side of the hammer and will be out of the path of its movement when the hammer is released.

The safety bar 82 is raised and lowered in the guide passage 64 by either of a pair of finger buttons 89 secured to the opposite sides of the safety bar at its bottom by pin means 90. The buttons 89 are accessible from either open side of the chamber 68, FIG. 4. This open-sided portion of the unified body 27 also forms a trigger guard. The buttons 89 operate in slots 89' of partition plate 63.

Figure 5:
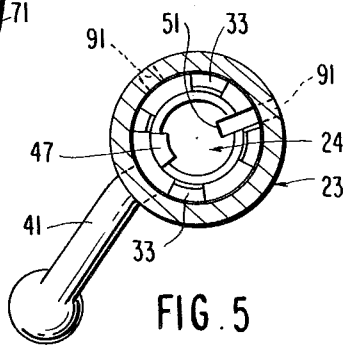
FIG. 5 is a transverse vertical section taken on line 5—5 of FIG. 3.

It should be noted that the action tube 23, FIG. 5, is provided with gas escape ports 91.

Figure 10:
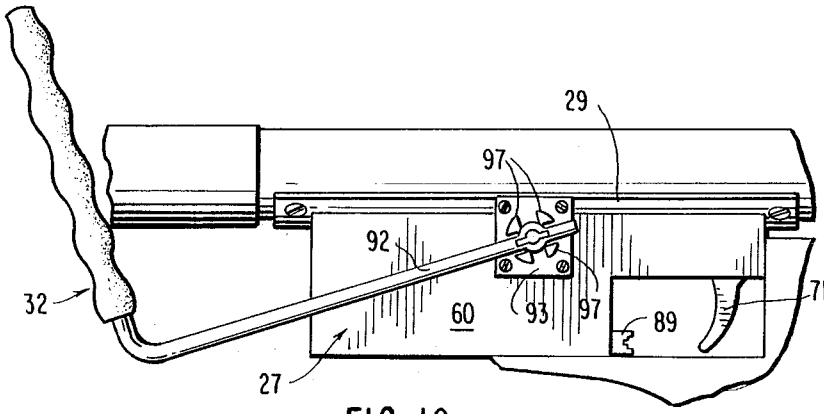
FIG. 10 is an enlarged fragmentary side elevation of the rifle showing an adjustable carrying handle thereof.

A feature of the invention is the provision of a conveniently adjustable carrying handle for the rifle, previously identified by the numeral 32. This handle is L-shaped, as shown, and includes an arm 92 extending adjacent to one side wall 60 of the body 27. A mounting block 93 for the handle 32 is attached to the body 27 as shown in FIG. 10 and a shaft 94, FIG. 11, attached to the arm 92 is biased by a spring 95 into a cavity 96 of the block 93. Circumferentially spaced detent lugs 97 on the outside face of the block 93 allow the arm 92 to be releasably locked in any of four rotated positions 90° apart.

The terms and expressions which have been employed herein are used as terms of description and not of limitation, and there is no intention, in the use of such terms and expressions, of excluding any equivalents of the features shown and described or portions thereof but it is recognized that various modifications are possible within the scope of the invention claimed.

I claim:

1. A bolt action rifle comprising an action tube, a barrel having a cartridge chamber secured to one end of the action tube, a stock secured to the other end of the action tube, a unitized body forming a cartridge magazine and a firing and safety mechanism mount attached to the action tube between the barrel and stock, the action tube having a longitudinal slot placing the interior of the action tube in communication with the interior of said body, a bolt disposed movably in the action tube and being bodily enclosed therein in all operative positions of the bolt, the action tube having a guide and locking slot for the bolt, a handle on the bolt guidingly engaged in said guide and locking slot, the bolt and action tube having rotationally cooperative bolt locking lugs to lock the bolt in a closed forward position within the action tube, a firing pin on the bolt, a cartridge case extractor on the bolt, and cooperative cartridge case ejector means on the action tube and bolt, the action tube having a loading and ejection port formed therethrough.

2. A bolt action rifle as defined in claim 1, and said firing pin being disposed in a bore formed longitudinally in said bolt at an angle to the longitudinal axis of the bolt with the forward end of the firing pin disposed on said longitudinal axis and the rear end of the firing pin disposed eccentrically with respect to the longitudinal axis of the bolt.

3. A bolt action rifle as defined in claim 1, and the action tube being internally threaded at its opposite ends to form a threaded connection with said barrel and stock, and the bolt locking lugs of the action tube and bolt comprising screw thread elements.

4. A bolt action rifle as defined in claim 3, and a threaded connection between the action tube and stock including a threaded plug engaged with the internal threads at the adjacent end of the action tube, an end cap engaging over the exterior of said adjacent end of the action tube and being received in a cavity of the stock, screws interconnecting the end cap and threaded plug, and a central axial bolt threadedly engaged with said threaded plug and being received through aligned apertures of the end cap and stock and engaging a surface of the stock and clampingly securing the end cap in said cavity of the stock to solidly connect the action tube and stock.

5. A bolt action rifle as defined in claim 1, and an adjustable multi-position carrying handle for the rifle attached to one side thereof adjacent to said unitized body.

6. A bolt action rifle as defined in claim 5, and the carrying handle being L-shaped and including an arm adjustably connected to the rifle through a yielding multi-position detent means.

7. A bolt action rifle as defined in claim 1, and the action tube having gas escape ports formed therethrough.

8. A bolt action rifle as defined in claim 1, and said cooperative cartridge case ejector means comprising a fixed ejector bar in the action tube, and an ejector bar slot formed in the exterior of said bolt whereby an extracted cartridge case can be moved by the bolt into engagement with the ejector bar.

9. A bolt action rifle comprising an elongated action tube, a barrel having a cartridge chamber secured to one end of the action tube in coaxial alignment therewith, a stock secured to the other end of the action tube, a bolt including firing pin and cartridge case extractor means disposed movably in the action tube and being fully contained and guided therein at all adjusted positions of the bolt during the operation of the rifle, cooperative guide and locking means for the bolt on the action tube and bolt, a unitized body defining a cartridge magazine and a firing and safety mechanism mount attached to the action tube between said barrel and stock, the action tube having a side wall slot in communication with the interior of said body, a pair of internal spaced parallel partition walls on the body between end walls thereof and defining in said body a guide passage across the axis of the action tube and bolt and being in intersecting relationship with said slot of the action tube, a safety bar movably held in said guide passage of said body and including a bolt locking end extension adapted to project through said slot of the action tube and to engage within a locking recess of the bolt, multi-position yielding detent means for said safety bar along said guide passage whereby the safety bar can be positioned in a rifle firing position, a hammer locking position, and a hammer and bolt locking position, a spring-loaded hammer pivoted on said body rearwardly of said guide passage adjacent to said slot of the action tube and adapted to swing through said slot to engage the firing pin upon release of the hammer, a spring-loaded trigger/sear on said body and having a tip adapted to engage in a notch of the hammer to secure the hammer in a cocked position, a stop element for the trigger/sear on said body to positively limit movement of the trigger/sear in one direction, and cartridge lifting and follower means within a magazine chamber of said body on the side of the guide passage away from said hammer and trigger/sear and being aligned with said slot of the action tube, whereby cartridges from the magazine chamber can enter the action tube through said slot when said bolt is retracted.

10. A bolt action rifle as defined in claim 9, and one of said partition walls defining said guide passage having a slot formed therethrough receiving an adjacent corner of said hammer whereby the hammer can engage the safety bar and be locked thereby.

11. A bolt action rifle as defined in claim 10, and said one partition wall having another pair of slots formed therethrough in parallel relationship, and a pair of safety bar actuating buttons secured to opposite sides of the safety bar and engaging through said last-named slots.

12. A bolt action rifle as defined in claim 9, and a cartridge ramp surface on the action tube adjacent to the forward end of said magazine chamber and slot of the action tube.

13. A bolt action rifle as defined in claim 9, and the hammer being provided with an angled surface at one side of its firing pin striking face.

14. A bolt action rifle as defined in claim 9, and said trigger/sear being mounted on said body through a trigger/sear shaft held on said body and being engaged by an elongated opening in the trigger/sear whereby said tip of the trigger/sear can release the hammer responsive to a minimal trigger/sear movement.

15. A bolt action rifle as defined in claim 9, and said multi-position yielding detent means comprising three spaced detent openings formed in one of said partition walls at different elevations therein, and a spring-loaded ball detent on the safety bar engageable selectively in any of said three detent openings.

16. A bolt action rifle as defined in claim 9, and said unitized body being substantially rectangular in cross section and being elongated relative to the axis of the action tube and including bottom and side walls and being open at its top and having top mounting flanges engaging the exterior of the action tube and being secured thereto.

17. A bolt action rifle as defined in claim 9, and said cartridge lifting and follower means comprising a spring in said magazine chamber and a cartridge follower element within the magazine chamber above said spring, said slot of the action tube being of a width adjacent to the magazine chamber to maintain the follower element captively held therein.

* * * * *